United States Patent [19]

Hait

[11] Patent Number: 4,884,551

[45] Date of Patent: Dec. 5, 1989

[54] OUTDOOR COOKING UNIT

[75] Inventor: Paul W. Hait, Los Gatos, Calif.

[73] Assignee: Pyromid, Inc., Redmond, Oreg.

[21] Appl. No.: 283,497

[22] Filed: Dec. 12, 1988

Related U.S. Application Data

[63] Continuation-in-part of Ser. No. 726,835, Apr. 24, 1985.

[51] Int. Cl.[4] ..... F24C 1/16

[52] U.S. Cl. ..... 126/9 R; 126/9 B; 126/25 R; 126/305

[58] Field of Search ..... 126/9 R, 9 A, 25 R, 126/25 A, 25 AA, 41 R, 39 R, 29, 146, 30, 304 R, 305; 219/354; 99/450, 449

[56] References Cited

U.S. PATENT DOCUMENTS

| | | | |
|---|---|---|---|
| 2,842,116 | 7/1958 | Hinderer | 126/9 R |
| 2,943,557 | 7/1960 | Suehlsen | 126/9 R |
| 3,194,429 | 7/1965 | Bouet | 220/85 |
| 3,353,527 | 11/1967 | Anderson | 126/25 |
| 3,450,123 | 6/1969 | Tidd | 126/25 R |
| 3,601,280 | 8/1971 | Mills | 220/63 R |
| 3,682,154 | 8/1972 | Mollete | 126/9 A |
| 3,765,397 | 10/1973 | Henderson | 126/25 R |
| 4,210,118 | 7/1980 | Davis et al. | 126/25 R |
| 4,254,863 | 3/1981 | Katcs et al. | 206/216 |
| 4,413,609 | 11/1983 | Tisdale | 126/25 R |
| 4,488,535 | 12/1984 | Johnson | 126/25 A |
| 4,508,094 | 4/1985 | Hait | 126/9 R |
| 4,531,505 | 7/1985 | Hait et al. | 126/9 R |
| 4,539,973 | 9/1985 | Hait | 126/43 |
| 4,545,359 | 10/1985 | Hait | 126/9 R |
| 4,624,238 | 11/1986 | Hait | 126/9 R |

FOREIGN PATENT DOCUMENTS

| | | | |
|---|---|---|---|
| 2439805 | 3/1976 | Fed. Rep. of Germany . | |
| 1467646 | 3/1977 | United Kingdom | 126/9 R |

OTHER PUBLICATIONS

The American Brakeshoe and Foundry Co.-Adv. 1944, "Protable-Grill".

*Primary Examiner*—James C. Yeung
*Attorney, Agent, or Firm*—Jack M. Wiseman

[57] ABSTRACT

A cooking unit has a frame or a bowl-shaped vessel. Supported by the frame or bowl-shaped vessel is a horizontal support with a center opening therethrough. A firebox vessel with an open top depends from the horizontal support and is disposed in the center opening of the horizontal support. A fire grate on which fuel elements are seated is disposed in the firebox vessel below the center opening of the horizontal support. A cooking grill is disposed over the center opening of the horizontal support. Combustion air enters the firebox vessel through an opening above the fire grate other than the open top of the firebox vessel to supply combustion air to the burning fuel elements. The interior of the firebox vessel reflects the heat produced by the fuel elements toward the food on the cooking grill.

25 Claims, 4 Drawing Sheets

Fig. 3
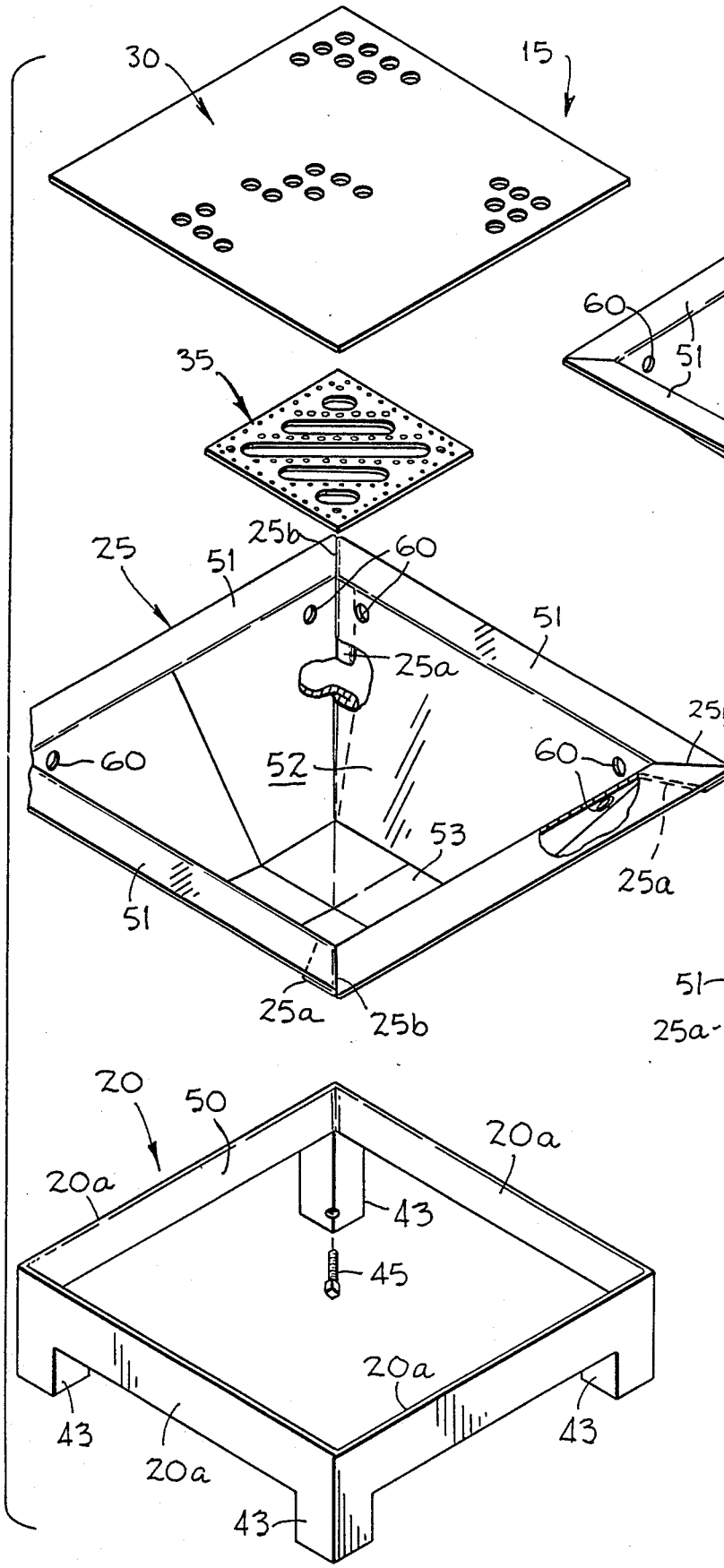
Fig. 4
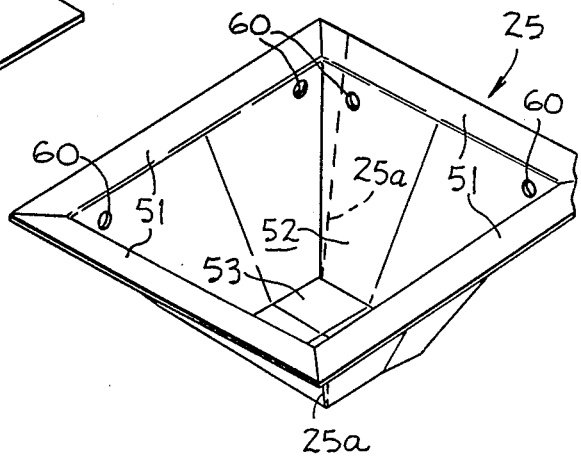
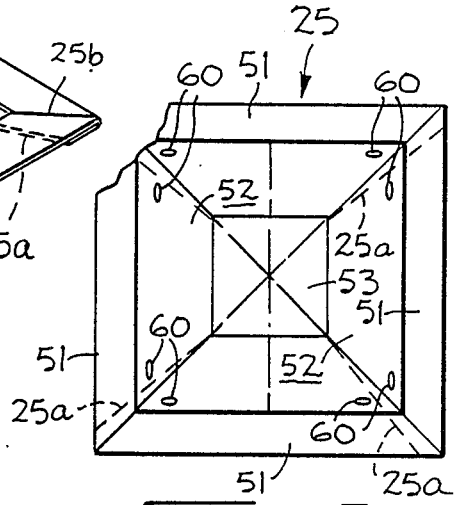
Fig. 5
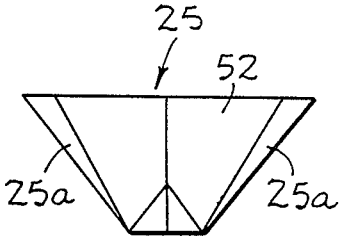
Fig. 6

Fig_14
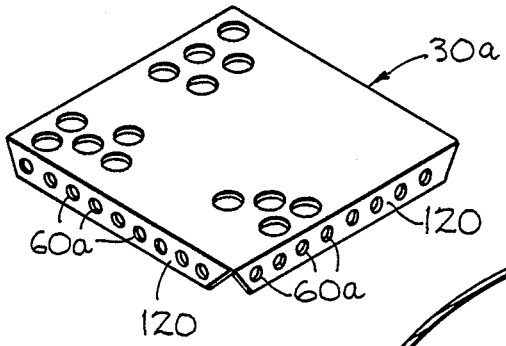
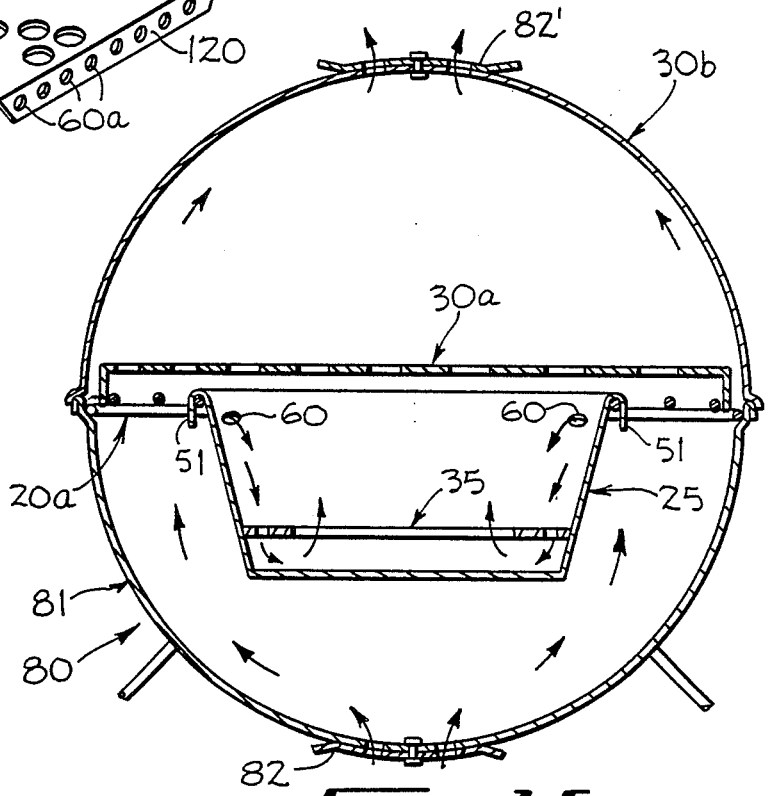
Fig_15
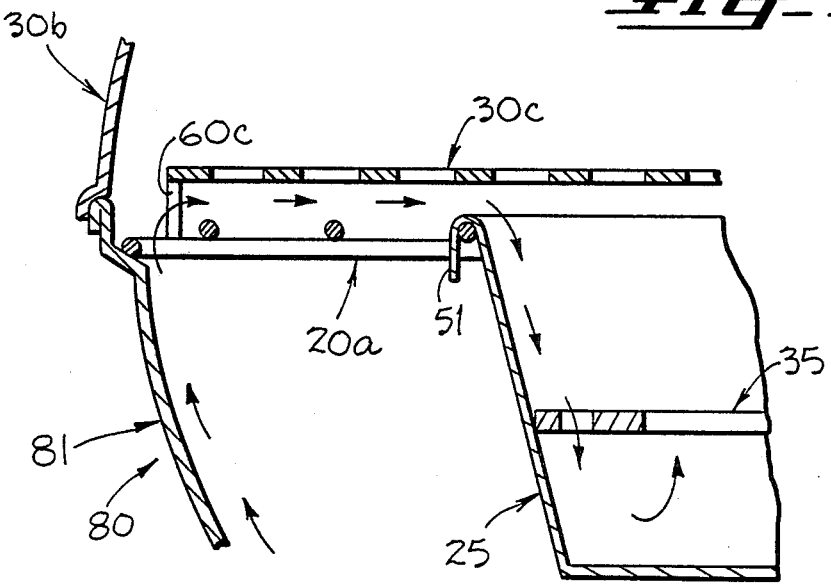
Fig_16

OUTDOOR COOKING UNIT

RELATED CASE

This application is a continuation-in-part of my copending U.S. application, Ser. No. 06/726,835, filed on Apr. 24, 1985, for Outdoor Cooking Unit With Disposable Component.

BACKGROUND OF THE INVENTION

The present invention relates in general to outdoor cooking units, and more particularly to an outdoor cooking unit using fuel elements, such as charcoal, briquettes, wood and the like.

Cooking by outdoor cooking units, such as kettle-type cooking units, has become very popular. However, presently available cooking units have become relatively inefficient. Such cooking units are difficult to clean and are generally too bulky to be transported with ease. The cooling down of such units after the cooking has been completed is relatively slow. Satisfactory provisons have not been provided to facilitate the removal of ashes and grease after the cooking unit has cooled down.

In the U.S Pat. No. 3,682,154, to Mollere, granted on Aug. 8, 1972, for Portable Disposable Charcoal Grill, there is disclosed a portable and disposable charcoal grill of cardboard lined with aluminum foil. The grill is collapsible into a package with the elements thereof nested together.

The U.S. Pat. No. 3,601,280, to Mills, granted on Aug. 24, 1971, for Disposable Aluminum Liner For Barbeque, discloses a fire-resistant disposable liner for a bowl-shaped portable barbeque. The liner is made of aluminum foil which is ribbed and shaped to fit on the inner wall of a bowl-shaped firebox. The spaces between the ribs form passageways below the fuel.

In the U.S. Pat. No. 4,254,863, to Katcs et al., issued on Mar. 10, 1981, for Barbeque Pack, there is disclosed a disposable barbeque pack comprising a fire container made of aluminum. The fire container may be crumpled up manually after being used.

In the U.S. Pat. No. 4,624,238, to Hait, issued on Nov. 25, 1986, for Device Interchangeable As An Outdoor Stove And A Table, there is disclosed a table as support for an outdoor cooking unit. The cooking unit includes hollow, truncated pyramidal support member and firebox.

The U.S. Pat. No. 4,508,094, to Hait, issued on Apr. 2, 1985, for Convertible Cooking Unit, discloses a truncated pyramidal firebox with inner reflective surfaces and a similar support member.

SUMMARY OF THE INVENTION

An object of the present invention is to provide a cooking unit that is more economical to manufacture and is more convenient for transporting and storing.

Another object of the present invention is to provide an arrangement for an outdoor cooking unit that enables ashes and the like to be disposed of conveniently and safely.

Another object of the present invention is to provide a cooking unit that has improved heat utilization by reflecting heat from the inner surfaces of tapered walls and from a reflecting bottom wall of a firebox and by a heat absorbing cooking grill having a dark colored or black food supporting elements.

Another object of the present invention is to provide a removable firebox vessel adapted for use with outdoor cooking units and particularly kettle-type outdoor cooking units.

A feature of the present invention is a portable firebox vessel adaptable for use with a support or a barbeque cooking unit that lends itself to improved fuel efficiency, improved transportability, facilitates the removal and the disposal of ashes and the like, facilitates the cleaning of the cooking unit and speeds up the cooling down of the cooking unit.

Briefly described, a cooking unit has a horizontal support with an opening therethrough. A cooking grill is disposed over the opening in the horizontal support. A firebox vessel with an open top and a closed bottom is supported by the horizontal support below the cooking grill. A fire grate supporting fuel elements is disposed within the firebox vessel. Combustion air is supplied to the fuel element by travelling over a path entering the firebox vessel and continuing below the fuel elements and continuing to expose the fuel elements to combustion air.

BRIEF DESCRIPTION OF THE DRAWINGS

FIG. 3 is a fragmentary view of the cooking unit shown in FIG. 2.

FIG. 4 is a fragmentary, reduced perspective view of a flexible sheet firebox vessel in an extended state embodied in the cooking unit shown in FIGS. 2 and 3.

FIG. 5 is a fragmentary plan view of the flexible sheet firebox vessel in an extended state shown in FIG. 4 and particularly illustrating the fold lines thereof.

FIG. 6 is a reduced, side elevation view of the flexible sheet firebox vessel shown in FIGS. 4 and 5 in a folded state.

FIG. 14 is a perspective view of a modification of the cooking grill and illustrating openings in the cooking grill for the flow of combustion air into the firebox vessel.

FIG. 15 is an enlarged vertical sectional view of the kettle-type barbeque shown in FIG. 9 taken along line 11—11 thereof with a hood and illustrating the flow of combustion air into the firebox vessel.

FIG. 16 is a diagrammatic, fragmentary vertical sectional view of a kettle-type barbeque showing a space between a cooking grill and a support for the flow of combustion air into the firebox vessel.

DETAILED DESCRIPTION OF THE PREFERRED EMBODIMENTS

Figure 1:
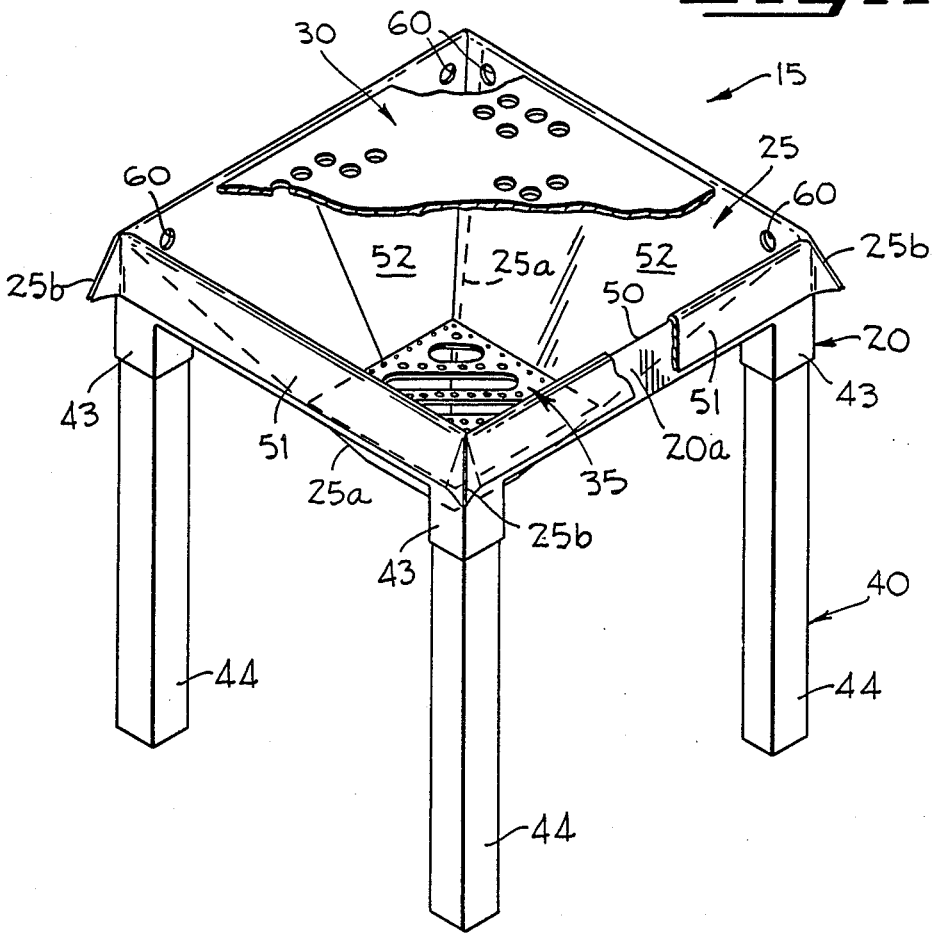
FIG. 1 is a fragmentary perspective view of a cooking unit embodying the present invention illustrated seated on a frame.

Illustrated in FIG. 1 is a cooking unit 15 embodying the present invention, which comprises a horizontal support 20; a removable, portable firebox vessel 25; a cooking grill 30; and a fire grate 35. In the exemplary embodiment, the horizontal support 20 is mounted on a suitable frame 40 with legs 44 received by sockets 43 of the support 20. Should a foldable frame be desired, then conventional hinge arrangements are used in lieu of sockets. Screws 45 (FIG. 3) may be employed to secure the legs 44 within the sockets 43, respectively.

Figure 2:
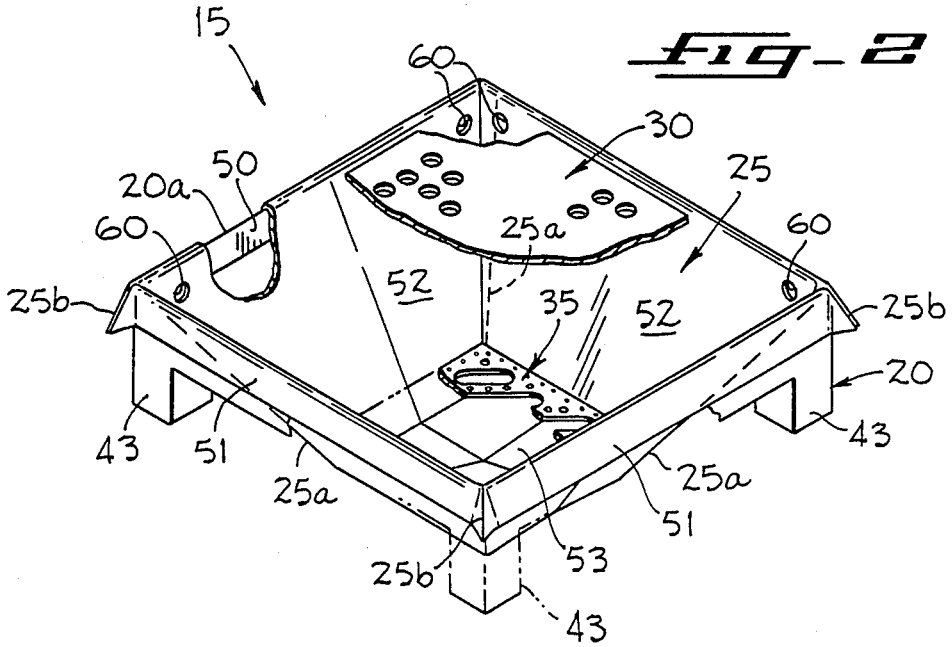
FIG. 2 is a fragmentary perspective view of the cooking unit shown in FIG. 1 removed from the frame.

Formed in the center of the support 20 is a suitable opening 50 for accommodating the firebox vessel 25 (FIGS. 1–3). The firebox vessel 25 is formed with flanges 51 along the perimeter thereof. The flanges 51, respectively, removably seat on the associate confronting walls 20*a* FIG. 7) of the support 20. Thus, the firebox vessel 25 is disposed within the opening 50 of the support 20 and is removably suspended from the support 20.

In the exemplary embodiment, the firebox vessel 25 has downwardly and inwardly sloping walls 52 extending from the open end of the firebox vessel 25 to a closed bottom wall 53 (FIG. 2). In the preferred embodiment, the firebox vessel 25 is made of suitable heavy duty aluminum foil. In the exemplary embodiment, the aluminum foil is a 50—50 annealed and preferably at least a 1.5 mil foil. It is apparent that the inner surface of the sloping walls 52 of the firebox vessel 25 may be coated with suitable reflecting material in the event the firebox vessel 25 is made from material other than aluminum foil or heat reflecting material.

By using suitable heavy duty aluminum foil for the firebox vessel 25, in the preferred embodiment, a heat reflecting surface for reflective heating is provided in the interior of the firebox vessel 25, and yet the firebox vessel 25 is not only light weight but also is sufficiently sturdy. By using aluminum foil for the firebox vessel 25, the firebox vessel may be precut; folded for convenient storage; and extended for use.

In FIGS. 4 and 5, the firebox vessel 25 is illustrated in the extended state for use in the cooking unit 15. FIG. 6 illustrates the firebox vessel 25 in a flat, folded state suitable for storage and transporting. After the cooking of food is completed, the flexible aluminum foil firebox vessel 25 may be folded as a bag for containing the used fuel elements as well as grease and discarding the folded bag-like firebox vessel 25 containing the used fuel elements and grease in a safe trash container or the like provided for such purposes for maintaining a clean and safe environment. In the preferred embodiment, the corners 25*a* of the flexible aluminum foil firebox vessel 25 are folded, as shown in FIGS. 1–6, at each of the four corners and are bent over the support 20*a* (FIGS. 2–7) which reinforce the strength thereof Suitable flaps 25*b* are provided at the corners of the flexible aluminum foil firebox vessel 25 to aid in the locking of the firebox vessel 25 on the support 20. Further in the unfolding of the flat packed firebox vessel 25, the fold lines are such that the bottom fold lines opposite one another serve to lock the firebox structure when formed into a flat bottom configuration.

In pending U.S. application, Ser. No. 06/726,835, filed by the inventor of the present application on Apr. 24, 1985, for Outdoor Cooking Unit With Disposable Component, there is disclosed the formation of a firebox liner made of aluminum foil. The firebox vessel 25 of the present application may be formed in the manner described in detail in said U.S. application Ser. No. 06/726,835 for the formation of the firebox liner. The cited application, Ser. No. 06/726,835, and the present application have a common assignee.

Figure 7:
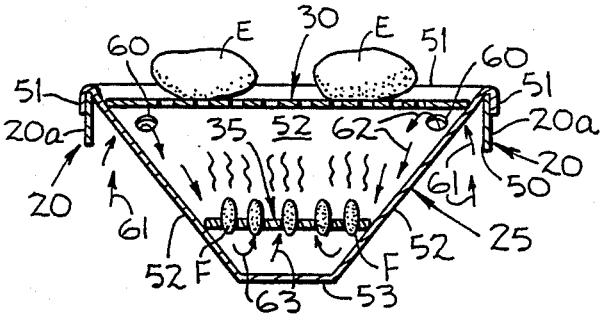
FIG. 7 is a diagrammatic illustration of the flow of combustion air advancing into the flexible sheet firebox vessel and the flow of reflected heat toward the food to be cooked.

Removably seated on the top surface of the support 20 over the opening thereof is the suitable cooking grill 30. Hence, the cooking grill 30 is disposed over the firebox vessel 25. In the preferred embodiment, the cooking grill 30 is black for absorption of heat. The surfaces of the cooking grill 30, in the exemplary embodiment, may be coated with black porcelain. Removably disposed within the interior of the firebox vessel 25 is the suitable fire grate 35 on which rests the fuel elements F (FIG. 7). The fire grate 35 is supported by the downwardly and inwardly sloping walls 52 of the firebox vessel 25 (FIGS. 1 and 2). The fire grate 35 is disposed below the cooking grill 30 and is generally parallel thereto. Through the heat reflective inner surfaces of the side walls 52 of the firebox vessel 25 and the truncated downwardly and inwardly sloping walls 52 of the firebox vessel 25 and the reflective bottom wall of the firebox vessel 25 and the black surfaces of the cooking grill 30, improved heat concentration is achieved for cooking food E (FIG. 7) on the cooking grill 30.

For supplying combustion air to fuel elements F seated on the fire grate 35 (FIG. 7), air in the vicinity of the support 20 enters openings 60, in the exemplary embodiment, at the upper corners of the firebox vessel 25 and at the junction between the flanges 51 and the sloping walls 52 as shown by the arrows 61. The combustion air then passes into the interior of the firebox vessel 25 and circulates downwardly as shown by the arrows 62 and 63 (FIG. 7) below the fire grate 35. Thereupon, the combustion air is supplied to the burning fuel elements and heat from the interior of the firebox vessel 25 reflects upwardly to cook the food E on the cooking grill 30 (FIG. 7). The fuel elements F may be disposed in a spaced, vertical orientation as disclosed in my copending application, Ser. No. 07/143,618, filed on Jan. 13, 1988, for Cooking Unit With Improved Fire Grate. The assignee of the present application is the assignee of the cited application, Ser. No. 07/143,618.

It is contemplated that combustion air enters the firebox vessel 25 from a suitable arrangement above the fire grate 35 and flows below the fuel elements F on the fire grate 35 and exposes the ignited fuel elements F to the combustion air. [This can be accomplished by suitable openings 60 in the firebox vessel 25 (FIGS. 1–5, 7 and 15) above the fire grate 35, or by a space 60*c* between a support 20*a* and a cooking grill 30*c* at the perimeters thereof (FIG. 16).] The combustion air openings are located, in the exemplary embodiment, in the vicinity of the perimeter of the cooking grill 30 to avoid grease or the like dripping from food to escape from the firebox vessel 25 through the combustion air openings 60.

Figure 8:
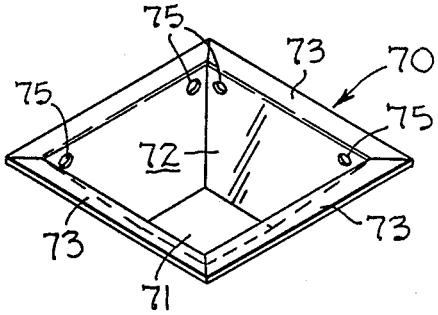
FIG. 8 is a perspective view of a relatively rigid firebox vessel adaptable for use in the cooking unit of the present invention.

Illustrated in FIG. 8 is a firebox vessel 70, which is a modification of the firebox vessel 25 shown in FIGS. 1–3. The firebox vessel 70 is non-combustible, fire repellant, generally rigid material. In the exemplary embodiment, the firebox material is made of stainless steel or aluminum. The firebox vessel 70 is open at the top thereof and is closed at the bottom thereto by a bottom wall 71. Side walls 72 of the firebox vessel 70 slope downwardly and inwardly to join the flat bottom wall 71. Flanges 73 of the firebox vessel 70 project outwardly along the perimeter of the firebox vessel 70 at the open top thereof and are adapted to seat on the support 20 in the manner shown in FIGS. 1 and 2, after the firebox vessel 70 is received by the center opening 50 in the support 20.

In order for combustion air to enter the interior of the firebox vessel 70, air in the vicinity of the support 20, in the exemplary embodiment, enters openings 75 at the upper corners of the firebox vessel 70 at the junction between the flanges 73 and the sloping walls 72. The combustion air flows in a manner heretofore described in connection with FIG. 7 to supply combustion air to fuel elements disposed within the firebox vessel 70. By employing the generally rigid firebox vessel 70 made of suitable material, such as stainless steel or aluminum, the firebox vessel 70 is reusable and, of course, reflects heat upwardly to heat food cooking on a cooking grill, such as the cooking grill 30 (FIGS. 1–3).

Thus, the firebox vessel 70 is suspended from the support 20 within the central opening 50 thereof. A fire grate similar to the fire grate 35 shown in FIGS. 1–3 is disposed within the firebox vessel 70 and seats on the downwardly and inwardly sloping walls thereof. Fuel elements are supported by the fire grate within the firebox vessel 70. Combustion air about the support 20 enters the openings 75 of the firebox vessel 70 and circulates below the fire grate and then rises to supply combustion air to ignited fuel elements. Heat from the burning fuel elements reflects upwardly within the firebox vessel 70 to heat food supported by the cooking grill over the firebox vessel 70. The various arrangements for the flow of combustion air heretofore described can be employed in connection with the firebox vessel 70.

Figure 9:
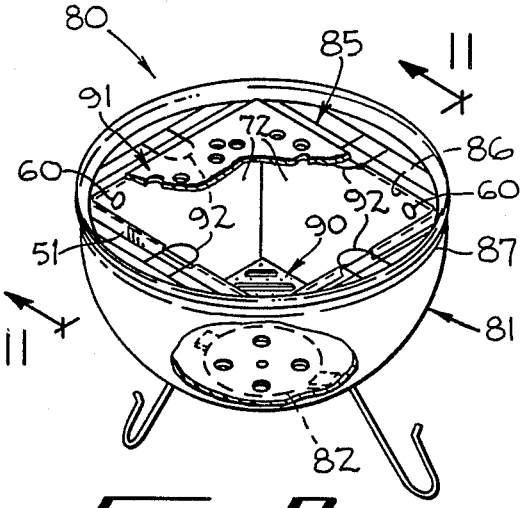
FIG. 9 is a fragmentary perspective view of a kettle-type barbeque in which the cooking unit of the present invention has been installed.
Figure 11:
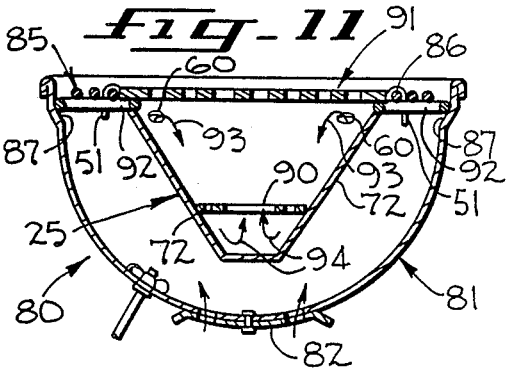
FIG. 11 is a vertical sectional view of the kettle-type barbeque shown in FIG. 9 taken along line 11—11 of FIG. 9.
Figure 10:
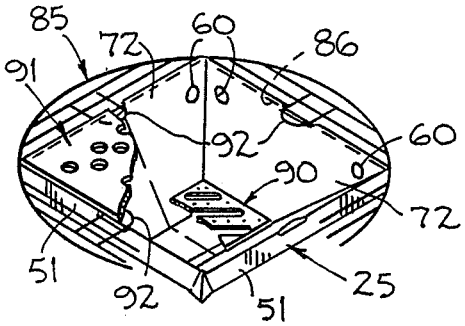
FIG. 10 is a fragmentary perspective view of the firebox vessel shown in FIGS. 1–7 perimetrically supported by a rod grill-type support.

Illustrated in FIGS. 9–11 is a kettle-type barbeque 80, which comprises a lower bowl-shaped cooking unit 81 and optionally an upper bowl-shaped cover **30*b*, shown in FIG. 15. At the bottom of the bowl-shaped cooking unit 81 is a conventional damper 82. Combustion air enters the bowl-shaped cooking unit 81 through the damper 82, when opened. When the bowl-shaped cover 30*b* is being used, a damper 82' at the top of the cover 30*b*, in the exemplary embodiment, would be opened for hot air to escape outside the bowl-shaped cooking unit 81**.

At the top section of the bowl-shaped cooking unit 81 is disposed a disc-shaped rod grill-type support 85 (FIGS. 9–11). The rod support 85 is mounted on the cooking unit 81, in the exemplary embodiment, through an annular flange 87 along the perimeter at the upper end thereof (FIG. 11). A suitable opening 86 (FIGS. 9–11) is formed in the rod support 85 to accommodate either the firebox vessel 25 or the firebox vessel 70. In the preferred embodiment, the firebox vessel 25 is employed. Hence, the discussion to follow will relate to the firebox vessel 25.

The firebox vessel 25 is removably disposed in the opening 86 of the cooking unit 81 with the flanges 51 of the firebox vessel 25 removably seated on the rods of the disc-shaped grill-type support 85 contiguous thereto (FIG. 11). Disposed within the firebox vessel 25 is the fire grate 90 on which the fuel elements are supported. Above the firebox vessel 25, a suitable cooking grill 91 (FIGS. 9–11) is removably disposed. The cooking grill 91 is removably seated on U-shaped projections 92 of the disc rod support 85. Food to be cooked by the kettle-type barbeque is disposed on the cooking grill 91.

In the exemplary embodiment, combustion air circulating within the kettle-type barbeque 80 (FIG. 11) enters the firebox vessel 25 through the openings 60 at the upper corners of the firebox vessel 25 at the junction between the flanges 51 and the sloping walls 72 of the firebox vessel 25 as shown by the arrows 93 in FIG. 11. The combustion air then passes into the interior of the firebox vessel 25 and circulates downwardly below the fire grate 90. Thereupon, the combustion air is supplied to the burning fuel elements and heat from the interior of the firebox 25 reflects upwardly to cook the food on the cooking grill 91 is shown by the arrows 94.

It is contemplated that combustion air enters the firebox vessel 25 from a suitable arrangement above the fire grate 90 and flows below the fuel elements on the fire grate 90 and exposes the ignited fuel elements to the combustion air (FIG. 11). This can be accomplished by suitable openings 60 in the firebox vessel 25 above the fire grate 35 (FIGS. 7 and 15) or by a space between the firebox vessel 25 and the cooking grill 91 at the perimeter thereof as heretofore described (FIG. 16).

Figure 13:
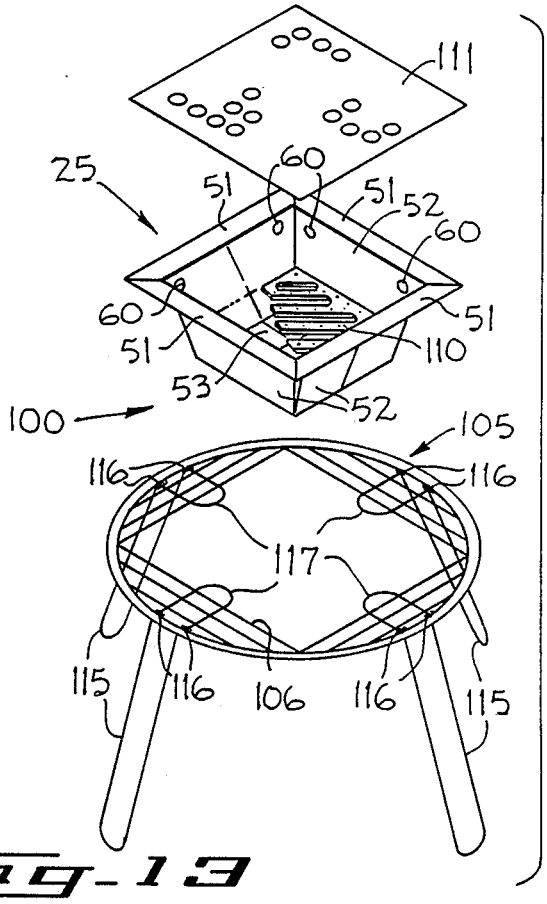
FIG. 13 is an exploded view of a cooking unit embodying the present invention and a frame therefor with foldable legs.

Illustrated in FIG. 13 is cooking unit 100 comprising a horizontally disposed, grill-type, disc-shaped support 105. Formed through the grill-type support 105 is a centrally located opening 106. Disposed within the opening 106 and suspended from the grill-type support is a firebox vessel, such as either the firebox vessel 25 or the firebox vessel 70. In the preferred embodiment, the firebox vessel 25 is disposed within the opening 106 and suspended from the grill-type support 105.

Disposed within the firebox vessel 25 is a fire grate 110. Disposed above the firebox vessel and supported by the grill-type support 105 is a suitable cooking grill 111. Fixed to the grill-type support 105 are inwardly extending U-shaped support members 117. Seated on the U-shaped support members 117 is the suitable cooking grill 111. Combustion air flows into the firebox vessel 25 through the openings 60 located in the vicinity of the perimeter of the firebox vessel 25 above the fire grate 110. The combustion air flows below the fuel elements on the fire grate 110 and exposes the ignited fuel elements to the combustion air.

Foldable legs 115 through suitable hinges 116 are pivotally mounted to the underside of the grill-type support 105. When extended outwardly and downwardly, the foldable legs 115 support the grill-type support 105.

In FIG. 14 is illustrated a cooking grill **30*a*, which is a modification of the cooking grill 30 shown in FIGS. 1–3. The cooking grill 30*a* includes depending flanges 120 along the perimeter thereof. Formed in the depending flanges are combustion openings 60*a* which enable combustion air to enter the firebox vessel. Thereupon the combustion air flows below the fire grate 35 and supplies combustion air to ignited fuel elements seated on the fire grate 35. The cooking grill 30*a'* shown in FIG. 15 is similar to the cooking grill 30*a*, except no combustion openings are formed in the flanges thereof. However, the firebox 25 in FIG. 15 does include the combustion openings 60 so that combustion air may enter the firebox 25** to supply combustion air to the ignited fuel elements in a manner heretofore described.

Figure 12:
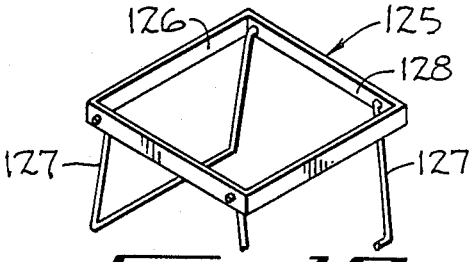
FIG. 12 is a fragmentary, perspective view of a support with foldable legs for the cooking unit embodying the present invention.

Illustrated in FIG. 12 is a support 125, which is a modification of the support 105 shown in FIG. 13. The support 125 comprises a square or rectangular frame 126. The frame 126 is supported by suitable foldable legs 127. Defined by the frame 126 is a central opening 128 in which is suspended a suitable firebox vessel, such as the firebox vessel 25 shown in FIG. 13. The flanges 51 of the firebox vessel 25, which are disposed along the perimeter of the firebox vessel 25, seat on the frame 126. The fire grate 110 (FIG. 13) is disposed within the firebox vessel 25 below the openings 60 through which flows the combustion air into the firebox vessel 25. Seated on the frame 125, while contacting the flanges 51 of the firebox vessel 25, is the cooking grill 111 (FIG. 13).

What is claimed is:

1. A cooking unit comprising:

(a) a horizontal support with an opening therethrough;

(b) a cooking grill disposed over said opening in said horizontal support;

(c) a firebox vessel having an open top and a closed bottom, said firebox vessel being supported within said opening of said horizontal support in depending relation by said horizontal support and disposed below said cooking grill, said firebox vessel including flanges along the perimeter thereof engaging said horizontal support for said horizontal support to support said firebox vessel within said opening of said horizontal support in depending relation, said firebox vessel being formed with at least one opening for the entry of combustion air into said firebox vessel; and (d) a fire grate for supporting a fuel element disposed within said firebox vessel below said opening of said firebox vessel, (e) combustion air enters said firebox vessel above said fire grate through the opening formed in said firebox vessel and flows below said fuel element for supplying combustion air to the fuel element on said fire grate.

2. A cooking unit as claimed in claim 1 wherein said firebox vessel is made of non-combustible, flexible material.

3. A cooking unit as claimed in claim 2 and comprising a bowl-shaped vessel with an open upper end upon which bowl-shaped vessel said horizontal support is disposed.

4. A cooking unit as claimed in claim 3 wherein said horizontal support comprises spaced, parallel rods, and wherein said flanges of said firebox vessel along the perimeter thereof engage said parallel rods to be supported thereby.

5. A cooking unit as claimed in claim 2 and comprising a frame upon which said horizontal support is disposed.

6. A cooking unit as claimed in claim 2 wherein said firebox vessel is removably supported by said horizontal support.

7. A cooking unit as claimed in claim 1 wherein said firebox vessel is made of non-combustible, flexible material that reflects heat generated in said firebox vessel toward said cooking grill.

8. A cooking unit as claimed in claim 7 and comprising a bowl-shaped vessel with an open upper end upon which bowl-shaped vessel said horizontal support is disposed.

9. A cooking unit as claimed in claim 8 wherein said firebox vessel is removably supported by said horizontal support.

10. A cooking unit as claimed in claim 7 and comprising a frame upon which said horizontal support is disposed.

11. A cooking unit as claimed in claim 7 wherein said firebox vessel is removably supported by said horizontal support.

12. A cooking unit as claimed in claim 7 wherein said cooking grill being formed with at least one black surface for the absorption of heat.

13. A cooking unit as claimed in claim 1 wherein said firebox material is made of aluminum foil.

14. A cooking unit as claimed in claim 1 wherein said firebox vessel is made of non-combustible relatively rigid material.

15. A cooking unit as claimed in claim 1 wherein said firebox vessel is made of non-combustible, relatively rigid material that reflects heat generated in said firebox vessel toward said cooking grill.

16. A cooking unit as claimed in claim 1 wherein said firebox vessel is made of stainless steel.

17. A cooking unit as claimed in claim 1 and comprising a bowl-shaped vessel with an open upper end upon which bowl-shaped vessel said horizontal support is disposed.

18. A cooking unit as claimed in claim 17 wherein said horizontal support comprises spaced, parallel rods, and wherein said flanges of said firebox vessel along the perimeter thereof engage said parallel rods to be supported thereby.

19. A cooking unit as claimed in claim 17 wherein said horizontal support has a disc configuration.

20. A cooking unit as claimed in claim 17 and comprising a hood disposed over the open upper end of said bowl-shaped vessel, said hood having a lower end adjacent the open upper end of said bowl-shaped vessel.

21. A cooking unit as claimed in claim 1 and comprising a frame upon which said horizontal support is disposed.

22. A cooking unit as claimed in claim 1 wherein said firebox vessel is removably supported by said horizontal support.

23. A cooking unit as claimed in claim 1 wherein said firebox is made of aluminum.

24. A cooking unit as claimed in claim 1 wherein said one opening is located in the vicinity of the perimeter of said firebox vessel.

25. A cooking unit as claimed in claim 1 and comprising foldable legs pivotally connected to said horizontal support, said foldable legs being extended outwardly and downwardly for supporting said horizontal support.

* * * * *